United States Patent [19]

Gilbert

[11] Patent Number: 4,756,258

[45] Date of Patent: Jul. 12, 1988

[54] AIR CURTAIN INCINERATOR

[76] Inventor: Kenneth W. Gilbert, P.O. Box 95-200, Stuart, Fla. 34995

[21] Appl. No.: 118,196

[22] Filed: Nov. 5, 1987

[51] Int. Cl.[4] ..... F23G 5/00

[52] U.S. Cl. ..... 110/346; 98/36; 110/235; 239/433; 239/548; 239/553; 239/566

[58] Field of Search ..... 110/235, 239, 346; 239/548, 553, 556, 559, 560, 566, 568, 553.5, 433, 434, 429; 98/36

[56] References Cited

U.S. PATENT DOCUMENTS

| | | | |
|---|---|---|---|
| 3,773,000 | 11/1973 | Applegate | 98/36 X |
| 4,183,307. | 1/1980 | Spitz et al. | 110/346 X |
| 4,699,047 | 10/1987 | Lee et al. | 239/566 X |
| 4,714,097 | 12/1987 | Binzen et al. | 98/36 X |

*Primary Examiner*—Edward G. Favors

*Attorney, Agent, or Firm*—Malin, Haley & McHale

[57] ABSTRACT

An air curtain incinerator and method for accelerating the burning of material in an open burning pit. The apparatus with an improved force draft air supply and manifold air distributor whereby the rate of burning, temperature and volume of air is controlled within the burning pit in such a manner that a down draft is created to the left and right of the center line thus forcing additional air into the burning pit and minimizing the amount of ash, smoke and debris which is released into the atmosphere. The apparatus is further provided with a centuri upstream of the manifold air distributor wherein an adjustable air inlet control the amount of supplemental air which is drawn into the supply conduit. The manifold air distributor includes a plurality of nozzles that extend the full length of the manifold and are directed into the burning pit at such an angle to produce a swirling effect within the pit under the air curtain to increase the resonant time long enough that all organic compounds to be destroyed with very little smoke or ash escaping.

11 Claims, 4 Drawing Sheets

AIR CURTAIN INCINERATOR

BACKGROUND OF THE INVENTION

Air curtain incinerators have been available in various forms for approximately the past ten years. These older units were merely designed as a source of pressurized air to feed a fire which was burning in an open pit without much attention being directed to the environmental effect. Air curtain incinerators have become more popular in recent years mainly because of the rapid growth in our economy and favorable economic conditions creating a need for more housing, shopping centers, commercial office space and the like. All these demands have increased the rate at which sites needed to be cleared to keep up with the demands. In earlier years, when the needs were not as great, it was common practice throughout the country for local governments to provide designated landfill areas where land site clearing debris could be trucked and buried. In large metropolitan areas, where there has been significant construction activities, this practice has resulted in the rapid unavailability of adequate additional sites for this purpose.

In an attempt to overcome this problem, open burning of the trees, grass, roots, etc. was undertaken. However, due to the many environmental limitations imposed by Federal, State, and local jurisdictions, a means had to be found whereby open burning can be carried out without violating these statutes or ordinances.

The apparatus of the present invention provides for the rapid, environmentally safe destruction of trees, brush, roots, etc. It permits incineration with a minimum of ash and smoke being released to the atmosphere, thereby meeting all Federal and State environmental regulations.

DETAILED DESCRIPTION OF THE PREFERRED EMBODIMENT

Figure 1:
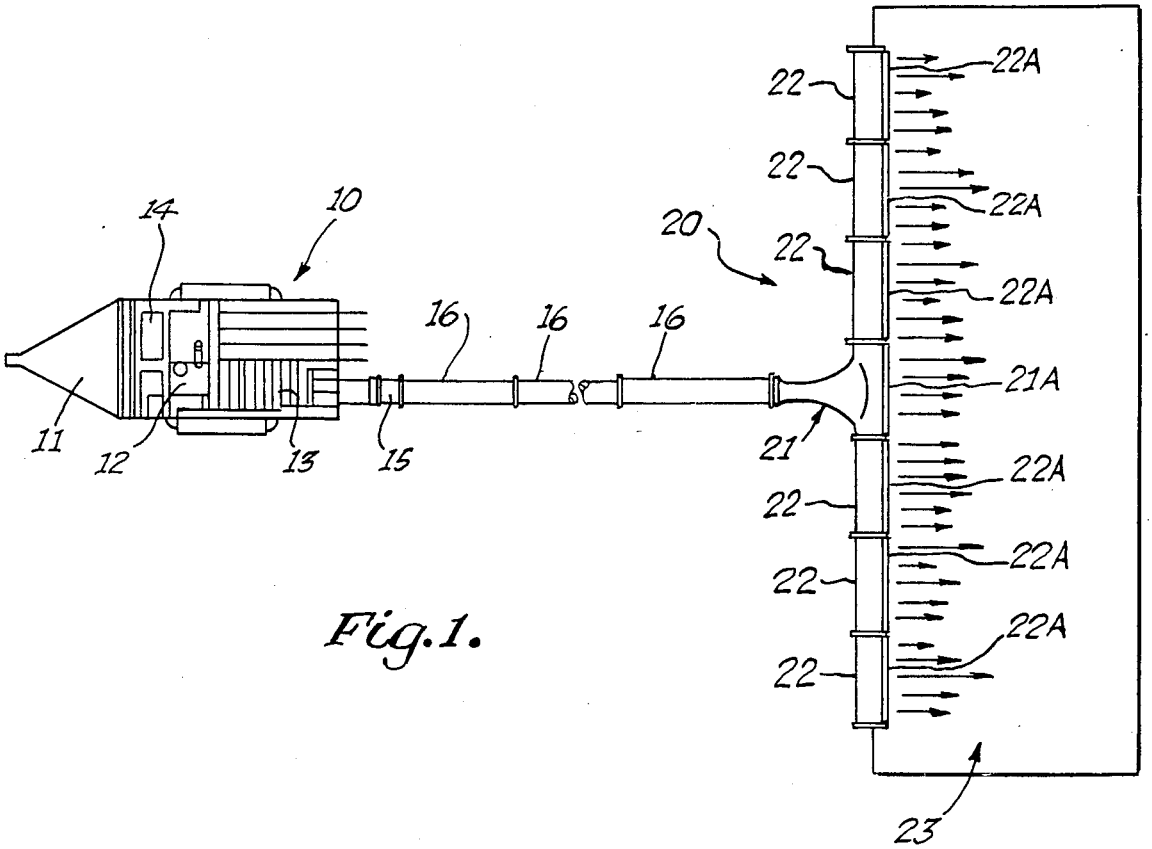
FIG. 1 is a plan view of the apparatus showing the positioning of the air manifold in place in an open pit.

Referring initially to FIG. 1 the overall apparatus is illustrated in an assembled condition and is shown in plan view. The overall apparatus consists of two main sub-assemblies 10 and 20. Sub-assembly 10 consists of an eighteen foot trailer 11 having a double axle to evenly distribute the load being carried thereon. Trailer 11 has a six cylinder diesel engine 12 securely mounted on its bed. The output of diesel engine 11 is operatively connected to a double intake centrifugal fan by means of a flexible belt or chain. Trailer 11 also provides space for fifty gallon fuel tank 14 for engine 12. The housing of fan 13 is provided with a transition zone 15 which changes the air flow passages as it leaves the fan 13 from square cross section to circular cross section. The purpose of the transition zone is to prepare the fan outlet for attachment to the first carrier pipe 16. There being three additional carrier pipes 16 each being eight feet in length and having an eighteen inch outside diameter. All four carrier pipes are provided with appropriate flanges to permit their consecutive interconnection with fan transition zone 15.

Sub-assembly 20 consists of an air accelerator/distributor manifold section 21 and six additional manifold sections 22. There being three manifold sections attached to each side flange portion of the air accelerator/distributor manifold section 21. The two end manifold sections 22 are capped at their outermost end to prevent a longitudinal escape of the air. The air accelerator distributor manifold section 21 and each of the six manifold sections is five feet in length. The entire manifold section and accelerator with its manifold produce a total length of thirty-five feet.

Sub-assembly 20 is shown positioned at the edge of burning pit 23. The approximate dimensions of burning pit 23 are as follows: length 60 feet, width 9–12 feet, and depth 7–12 feet.

Figure 2:
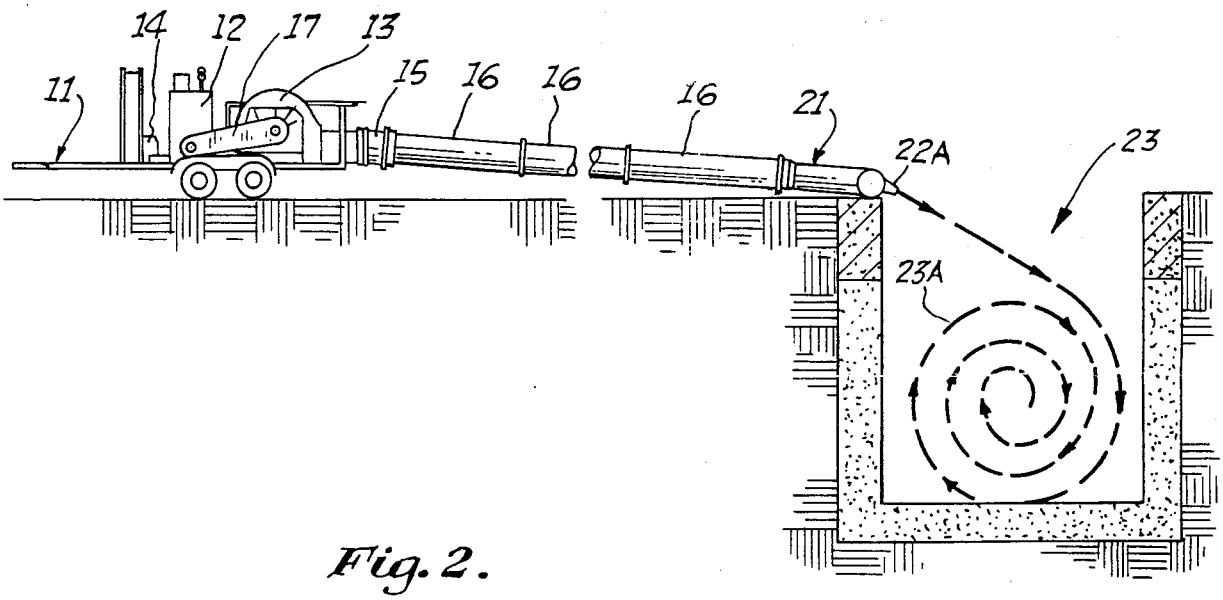
FIG. 2 is a side view of the apparatus with the open pit in cross section.

Referring now to FIG. 2 which is a side view of the apparatus shown in FIG. 1 and further showing burning pit 23 in cross section to illustrate the swirling action produced by the pressurized air leaving the manifold sections and fire burning in the pit 23.

Figure 3:
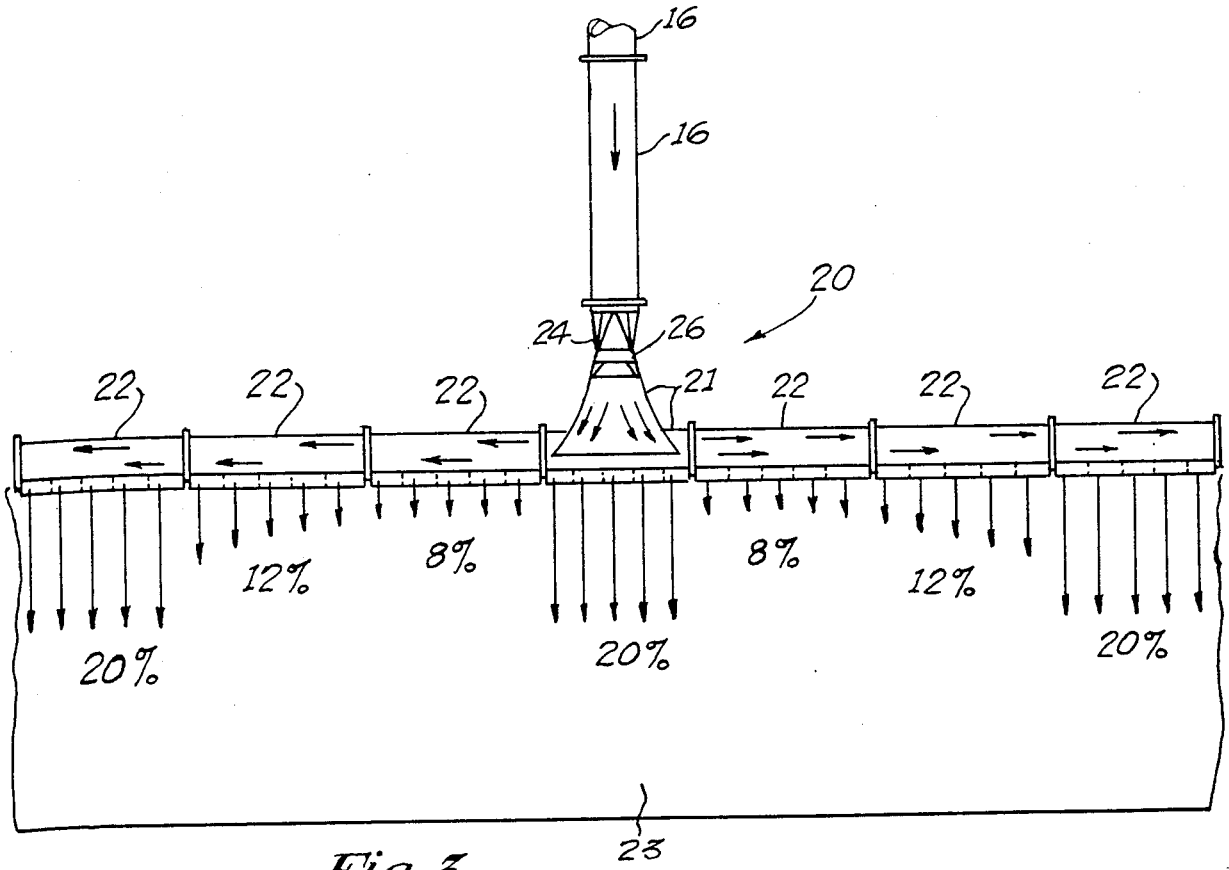
FIG. 3 is a detailed view of the manifold section releasing the air into the open pit.

FIG. 3 is a plan view of the second sub-assembly 20 positioned at ground level overlapping the edge of pit 23. As can be seen from this drawing, air accelerator/-distributor section 21 receives pressurized air from carrier pipe 16. A second transition section 24 is provided to change from circular to square cross-section and is located immediately upstream of air accelerator/distributor section 21. Air accelerator section 21 feeds air to the nozzles of the six manifold sections 22 as well as its own nozzles. The total volume of air received from the second transition section 24 is divided into five equal streams A, B, C, D and E within the air accelerator 21. The distribution of air within the distributor/accelerator is as follows: 20% of the air flow is directed to each of the end manifold sections 22 and also to the manifold section of accelerator 21 via air streams A, C and E. The remaining 40%, air streams B and D, is split such that approximately 12% will be discharged by each of the manifold sections immediately inboard of each outermost manifold section with the remaining 16% being equally divided between the next two innermost manifold sections 22 resulting in an 8% distribution to each of these last two sections. The length of the arrows coming out of the nozzles is directly related to the quantity of flow coming out of the respective manifold sections. The greatest concentration of air being at the center and two outer end sections of the sub-assembly.

Figure 4:
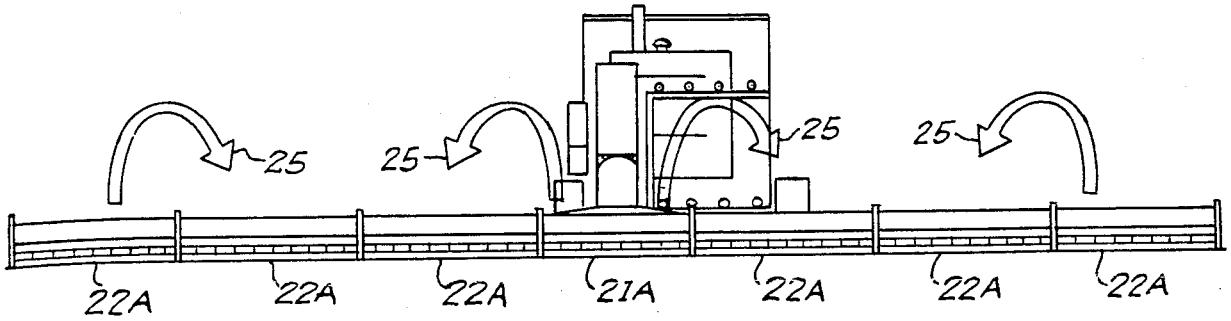
FIG. 4 is an end view of the manifold system as it releases the air into the pit showing the air currents produced by the burning fire in the pit.

FIG. 4 is an illustration of the downdraft currents produced by our unique manifold system. As pointed out supra, the distribution is such that the amount of air is greatest at the center and outermost ends of the manifold assembly resulting in a more intense fire in the pit at these sections which cause the down draft as indicated by arrow 25. Since the fires in the intermediate sections (between the center and two outermost sections) are burning at a cooler and lesser rate, they are trying to catch up with the more tense fire sections, such, the formation of these down drafts. This feature is a very significant aspect of the invention since the intense burning ensures a complete, rapid fire and the formation of a down draft pull outside air into the pit 23 rather than releasing smoke and ash to the atmosphere above the fire pit 23.

Figure 5:
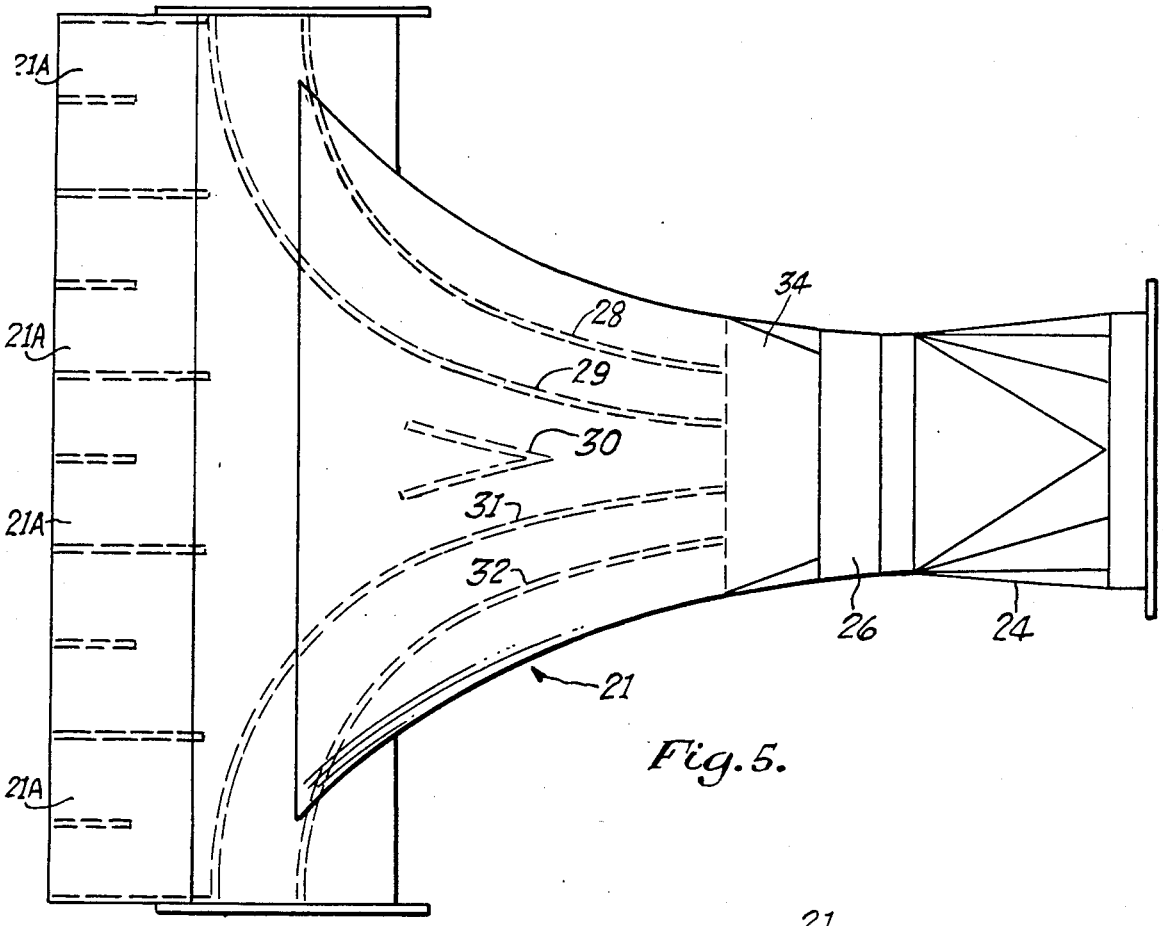
FIG. 5 is a detailed view of the manifold showing its multiple passages preceeding the manifold section.

FIG. 5 is a detailed showing of the air accelerator/-distributor section 21. As indicated earlier, accelerator/distributor section 21 is provided with an integrally second transition section 24 wherein flow cross-section is changed. Immediately downstream of the second transition section is an adjustable inlet 26 for controlling the amount of additional air admitted into air accelerator/distributor section 21. It is to be noted that the additional air inlet is located in the venturi section 27 wherein the cross section of the internal flow is at its minimum and the velocity is at its maximum. Thus creating a suction at the adjustable inlet 26 to pull in additional air. As the air leaves venturi section 27, the cross sectional flow area increases significantly and the volume of air flows therethrough is divided into five equal streams of air A, B, C, C and E. Accelerator/distributor section 21 is shown with manifold 28–32 in dashed lines since they are hidden by the upper housing portion of the accelerator/distributor 21. Manifold 30 takes its 20% of the air flow and feeds it all to center manifold section of the second sub-assembly 20 for discharge out through its nozzle 33.

Figure 6:
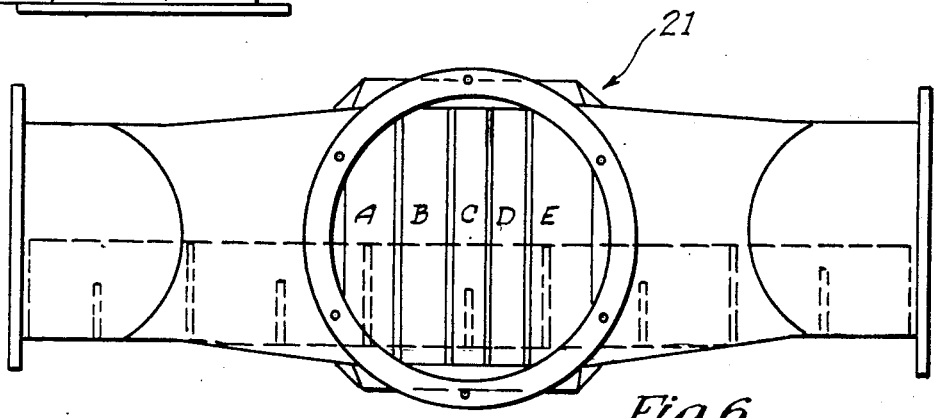
FIG. 6 is an end view taken along the lines 6—6 of FIG. 5.

FIG. 6 is an end view looking in the direction of arrows 6—6 of FIG. 1 wherein air stream A, B, C, D and E are shown.

Figure 7:
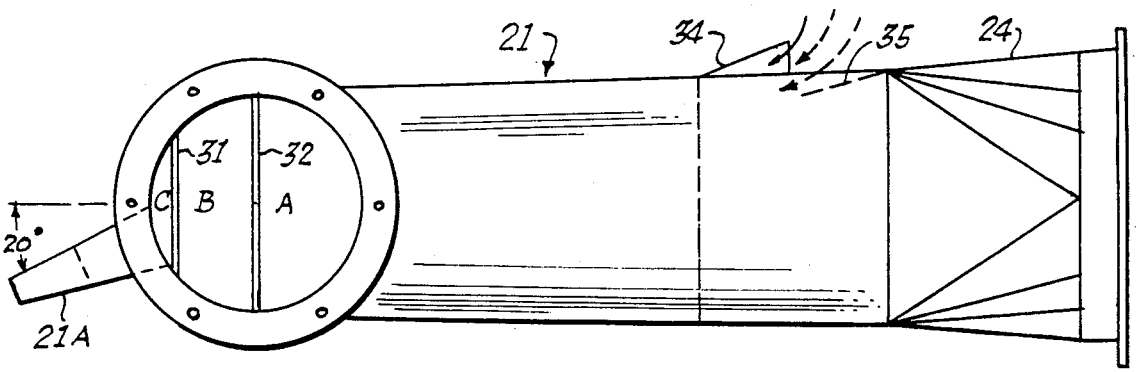
FIG. 7 is a side view of the manifold section showing the supplemental air intake and the nozzle section relative to the pit.

FIG. 7 is the left side view of FIG. 5 showing flow passages A, B and C and manifold 32 and 31. In addition, the single nozzle 33 is shown as being positioned at an angle of 20° below horizontal. However it is to be kept in mind that there are a plurality of such nozzles extending the full width of air accelerator/distributor section 21 and each of the six manifold sections 22. Also there is shown a raised air scoop 34 with an adjustable flap 35 to control the amount of air being admitted through the adjustable inlet 26.

Figure 8:
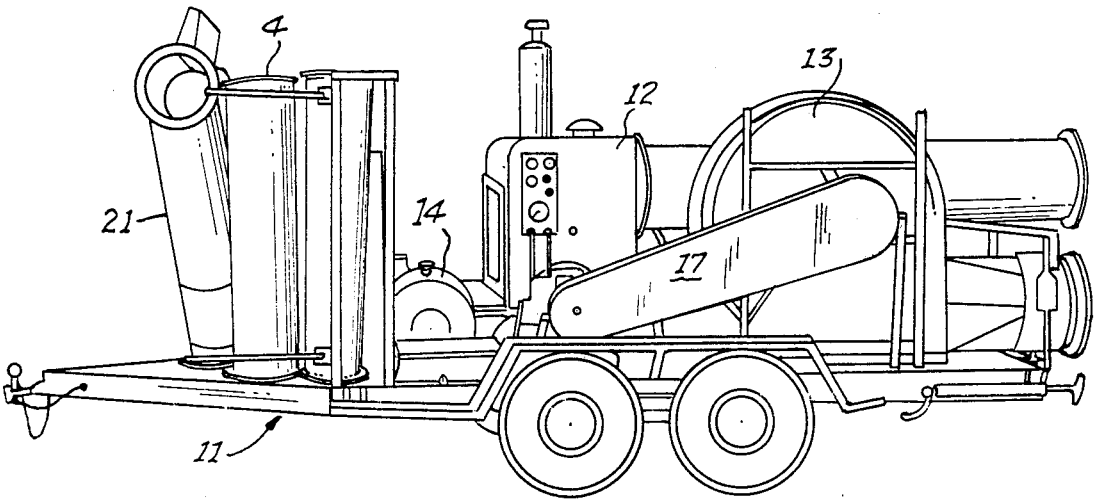
FIG. 8 is a showing of the trailer and all the components mounted thereon prior to assembly.

FIG. 8 is a showing of all the components mounted on trailer 11 to illustrate the compactness and portability of the apparatus. The air accelerator/distributor 21 is shown in a vertical position along side carrier pipe 4. The diesel engine 12 is centrally positioned over the first axle considered the heaviest of the components. Fuel tank 14 is positioned next to engine 12. Fan 13 is mounted close to the second axle and is operatively connected to diesel engine 12 by an endless drive means (either belt or chain) which is covered by a guard 17. Manifold sections 22 are attached on the backside of fan 13. Appropriate means such as chains are utilized to secure the pipe and manifold sections on the trailer.

Having thus described my invention, I claim:

1. An apparatus for directing a curtain of air over material burning in a generally rectangular burning pit wherein the improvement comprises:

a first sub-assembly and a second sub-assembly;

said first sub-assembly including drive means and a centrifugal fan operatively connected thereto and having air carrier means connected to said centrifugal fan;

said second sub-assembly including air distributor/accelerator means and a plurality of conduit manifold nozzle sections attached thereto wherein said air distributor/accelerator means increases the velocity of air flowing therethrough and is provided with supplemental air inlet means prior to its being distributed into five equal flow passages for further distribution to said manifold sections and their associate nozzles.

2. An apparatus of the character defined in claim 1 wherein said drive means comprises a power source, a flexible drive member operatively connecting said power source to said centrifugal fan to impart rotation thereto.

3. An apparatus of the character defined in claim 1 wherein said air carrier means comprises a plurality of interconnected flanged conduit sections, said flange conduit sections receiving discharged air from said centrifugal fan and delivering the air to said air distributor/accelerator means for further distribution.

4. An apparatus of the character defined in claim 1 wherein said air distributor/accelerator means is provided with a plurality of internal baffles for channeling said air flow into said five equal flow passages.

5. An apparatus of the character defined in claim 4 wherein said manifold and said air distributor/accelerator cooperate with further baffles in said plurality of conduit manifold sections whereby the central and two outermost sections of said plurality of conduit manifold nozzle sections each receive 20% of the total air volume and the remaining 40% of air volume is distributed to the remaining four sections of said plurality of conduit manifold nozzle sections.

6. An apparatus of the character defined in claim 5 wherein said remaining four sections of said plurality of conduit manifold nozzle sections receives 8% and 12%, respectively, to each side of said central conduit manifold nozzle sections.

7. An apparatus of the character defined in claim 1 wherein said air distributor/accelerator means includes a venturi section wherein the air velocity is at its maximum and its pressure is low, thus creating an optimum condition for admitting supplemental air into the air stream flowing therein.

8. An apparatus of the character defined in claim 7 wherein said supplemental air inlet means includes an adjustable flat vane which can be incrementally closed or opened to control the amount of supplemental air entering therethrough.

9. A method of controlling the burning of trees, brush, roots, and the like in an open burning pit wherein the temperature and rate of burning is so controlled that downdrafts are produced over portions of the pit to reduce the amount of pollutants released into the atmosphere, said method comprising the steps of:

(a) providing pressurizing means to supply air to the fire;

(b) restricting the air flow passage sufficiently to produce a venturi effect and a corresponding velocity increase and pressure decrease;

(c) admitting supplemental air in the area of said restricted air flow passage;

(d) controlling the distribution of air entering into said burning pit whereby the amount of air at the center and end portion of the burning pit is sufficient to accelerate the rate of burning and increase the temperature therein resulting in downdrafts being created between the center and each end portion of said burning pit.

10. A method of controlling the burning of trees, brush, roots, and the like as defined in claim 9 wherein said step of admitting supplemental air is further defined as including the provision of an air inlet with flow control means therein, whereby the amount of air admitted through said supplemental air inlet is controllable.

11. A method of controlling the burning of trees, brush, roots, and the like as defined in claim 9 wherein said step of controlling the distribution of air entering said burning pit is further defined as including the provision of an air distributor and a plurality of manifold nozzle sections;

said air distributor and said manifold nozzle sections provided with baffles therein;

said baffles forming passages which direct the air into said plurality of manifold nozzle sections whereby the rate of burning and the temperature of the fire are controlled to produce the desired downdrafts.

* * * * *